US007773044B2

(12) United States Patent
Oksanen et al.

(10) Patent No.: US 7,773,044 B2
(45) Date of Patent: Aug. 10, 2010

(54) METHOD FOR ENHANCING AN ANTENNA PERFORMANCE, ANTENNA, AND APPARATUS

(75) Inventors: Markku Oksanen, Helsinki (FI); Pekka Ikonen, Helsinki (FI); Markku Heino, Espoo (FI); Eira Seppälä, Helsinki (FI); Reijo Lehtiniemi, Helsinki (FI)

(73) Assignee: Nokia Corporation, Keilalahdentie, Espoo (FI)

( * ) Notice: Subject to any disclaimer, the term of this patent is extended or adjusted under 35 U.S.C. 154(b) by 220 days.

(21) Appl. No.: 12/109,778

(22) Filed: Apr. 25, 2008

(65) Prior Publication Data

US 2009/0267854 A1 Oct. 29, 2009

(51) Int. Cl.
*H01Q 1/00* (2006.01)

(52) U.S. Cl. ..... 343/787; 343/700 MS

(58) Field of Classification Search ..... 343/787, 343/700 MS, 702

See application file for complete search history.

(56) References Cited

U.S. PATENT DOCUMENTS 4,877,516 A 10/1989 Schram
6,114,962 A * 9/2000 Wiklof et al. ..... 340/572.8
6,329,959 B1 12/2001 Varadan et al.
6,437,747 B1 8/2002 Stoiljkovic et al.
6,842,140 B2 1/2005 Killen et al.
2002/0005805 A1 * 1/2002 Ogura et al. ..... 343/700 R
2004/0164907 A1 8/2004 Killen et al.
2006/0125703 A1 6/2006 Ma et al.

FOREIGN PATENT DOCUMENTS

EP 1580841 9/2005

OTHER PUBLICATIONS

J. Ollikainen; "Design and Implementation Techniques of Wideband Mobile Communications Antennas;" Ph.D. Dissertation, TKK Helsinki University of Technology; Nov. 8, 2004; whole document.
R. Jones; "RF-MEMS Enable Tunable Antennas—Antenna design for mobile applications is becoming increasingly complex, requiring the flexibility of MEMS technology to meet the convergence of new features and applications;" retrieved from the Internet on Apr. 28, 2008; http://www.semiconductor.net/article/CA6436113.html; whole document.
O. Kivekäs, et al; "Frequency-tunable internal antenna for mobile phones;" Proc. 13th IEEE International Symposium on Personal, Indoor and Mobile Radio Communications (PIMRC 2002), Lisbon, Portugal, Sep. 15-18, 2002; pp. 1882-1887.

* cited by examiner

*Primary Examiner*—Tho G Phan
(74) *Attorney, Agent, or Firm*—Alfred A. Fressola; Ware, Fressola, Van Der Sluys & Adolphson, LLP

(57) ABSTRACT

The invention relates to a method for enhancing an antenna performance, wherein the property of the antenna substrate is modified by using an ultrasonic field. The invention also relates to an antenna comprising the modified antenna substrate, and to an apparatus comprising the modified antenna substrate.

24 Claims, 3 Drawing Sheets

METHOD FOR ENHANCING AN ANTENNA PERFORMANCE, ANTENNA, AND APPARATUS

TECHNICAL FIELD OF THE INVENTION

The invention relates to a method for enhancing the performance of communications antennas. The invention also relates to an antenna having an enhanced performance. Furthermore, the invention relates to an apparatus comprising an antenna having an enhanced performance.

BACKGROUND OF THE INVENTION

An antenna tuning can be achieved for example by connecting lumped elements (capacitors, inductors) to an antenna structure or by manually changing antenna structural dimensions, such as the electrical length of the antenna element or a distance to a ground.

Moreover, it is possible to use different materials, which have a certain magnetic permeability or dielectric constant, embedded in between a ground plane and an antenna element. Also, it is possible to switch between different matching circuit states for varying an antenna matching band.

Several articles in the open scientific literature describe tuning methods for microstrip antenna elements. For example reference [1], wherein especially included papers [P8] and [P9], and the references therein. Proposals have been made, for example, to connect a tunable reactance (e.g. tunable capacitor) between an antenna element and a ground plate, to utilise switchable slots, or to utilise a switchable matching circuit for tuning a matching band location. In addition, in reference [2] is presented an overview of RF-MEMS enabled tunable antennas, in reference [3], which corresponds to preceding paper [P9], is presented a transmission line tuning, and in reference [4], for one, is disclosed a movable dielectric material together with a tunable planar inverted F antenna (PIFA).

Since the trend in a communications antenna design is towards smaller physical dimensions and as small as possible number of antennas, the antenna tuning plays an important role. The efficient re-use of the mobile phone antennas through a low cost tuning would be highly desirable, particularly if very fast tuning would be possible.

SUMMARY OF THE INVENTION

One object of the invention is to provide a method for enhancing an antenna performance, an antenna having an enhanced performance, and an apparatus comprising an antenna having an enhanced performance.

The object of the invention is fulfilled by providing a method, wherein a property of an antenna substrate is modified by using an ultrasonic field.

The object of the invention is also fulfilled by providing an antenna, which comprises an antenna substrate having a property, which is modifiable by an ultrasonic field.

The object of the invention is also fulfilled by providing an apparatus, which comprises an antenna substrate having a property, which is modifiable by an ultrasonic field.

According to an embodiment of the invention the electrical length of the antenna element is altered dynamically through a sophisticated parameter modification of the antenna substrate material for changing the resonant frequency of the antenna.

An embodiment of the present invention relates to a method comprising modifying a property of an antenna substrate (130, 210) by using an ultrasonic field.

In addition, an embodiment of the present invention relates to an antenna comprising an antenna substrate (130, 210) having a property, which is modifiable by an ultrasonic field.

Furthermore, an embodiment of the present invention relates to an apparatus comprising an antenna substrate (130, 210) having a property, which is modifiable by an ultrasonic field.

Further embodiments are defined in dependent claims.

According to an embodiment of the invention a property of an antenna substrate is modified by using an ultrasonic field, whereupon said antenna substrate is exposed to the ultrasonic field produced by an ultrasonic transducer.

According to an embodiment of the invention at least a portion of the antenna substrate comprises magnetic particles, which can be metallic particles and/or ceramic particles. On the other hand, it is possible that the magnetic particles comprise composite particles having metallic cores with electrically insulating coatings and/or electrically insulating cores with metallic coatings. At least some of these magnetic particles are submicron particles, i.e. at least some of the particles having a largest dimension that is less than one micron.

According to an embodiment of the invention at least some of the magnetic particles, which are disclosed in any of previous embodiments, each having a refractive index differing from a refractive index of the at least a portion of said antenna substrate.

According to an embodiment of the invention at least a portion of the antenna substrate, which is disclosed in any of previous embodiments, comprises a dielectric fluid, which, for one, includes the magnetic particles. Since the magnetic particles are surrounded by the dielectric fluid, the particles have a freedom to move if the ultrasonic field provided by the ultrasonic transducer is applied into the dielectric fluid.

According to an embodiment of the invention the magnetic particles, which are disclosed in any of previous embodiments, are arranged into a new arrangement in the at least a portion of said antenna substrate by said ultrasonic field in order to modify the property of the antenna substrate comprising the particles.

According to an embodiment of the invention, in the rearranging of the magnetic particles, which is disclosed in any of previous embodiments, the ultrasonic field is applied into the at least a portion of the antenna substrate and that induces the concentration of the magnetic particles in areas of a high pressure. When the ultrasonic field is shut off, the magnetic particles will distribute evenly in the at least a portion of said antenna substrate.

According to an embodiment of the invention, in the rearranging of the magnetic particles, which is disclosed in any of previous embodiments, a standing wave is established into the antenna substrate portion or the antenna substrate, whereupon it is achieved the concentration of the magnetic particles (one or more magnetic particle layer) into one or more nodal planes of the standing wave.

According to an embodiment of the invention, in the rearranging of the magnetic particles, which is disclosed in any of previous embodiments, a frequency of the ultrasonic field provided by the ultrasonic transducer is adjusted in order to control a number of the nodal planes of the standing wave in the at least a portion of the antenna substrate.

According to an embodiment of the invention the property of the antenna substrate, which is disclosed in any of previous embodiments, is a magnetic permeability or dielectric constant.

According to an embodiment of the invention an antenna, which has an antenna substrate having a property modifiable by an ultrasonic field according to any of embodiments described in this document, is a patch antenna. The antenna can also be any other microstrip antenna type such as a stacked microstrip antenna.

According to an embodiment of the invention an apparatus, which has an antenna substrate having a property modifiable by an ultrasonic field according to any of embodiments described in this document, is a mobile communications device such as a mobile station. The apparatus can also be a smaller unit than the mobile communications device. It can be e.g. a component having an antenna substrate with a property modifiable by an ultrasonic field, which can be installed inside the mobile communications device.

The method offers a simple approach to the antenna tuning and enables the use of a single antenna at different frequencies. The method further provides a low cost and fast antenna tuning method. Also, this method provides the accurate spatial control of the nanoparticles in an antenna substrate.

BRIEF DESCRIPTION OF THE DRAWINGS

Next, the aspects of the invention will be described in greater detail with reference to exemplary embodiments in accordance with the accompanying drawings, of which

DETAILED DESCRIPTION

Figure 1:
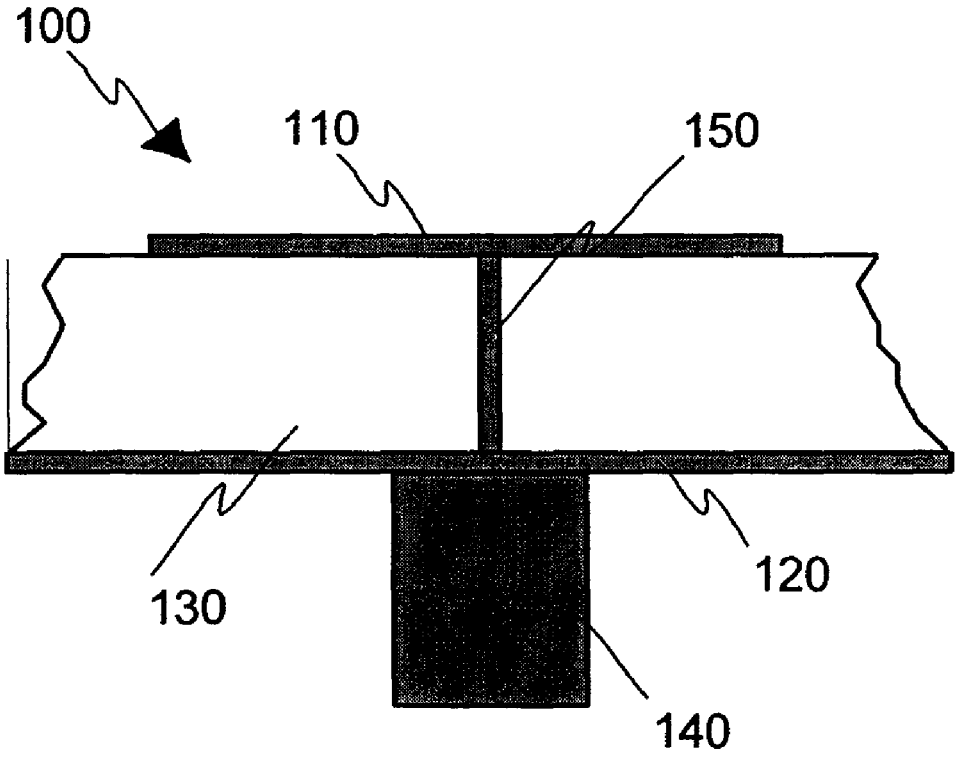
FIG. 1 illustrates a schematic diagram of a patch type antenna.

FIG. 1 illustrates a possible setup in case of a patch antenna 100, with a thin radiating patch 110 on one side and a ground plane 120 on another side. Between the patch 110 and the ground plane 120 is an antenna substrate 130. The antenna substrate 130 is a dielectric material having a certain dielectric constant, which defines the electric features of the antenna substrate 130.

In addition, the patch antenna 100 comprises a feed line 140 and a probe feed 150 (of a coaxial cable) for coupling electromagnetic energy into the patch 110 and/or out of the patch 110. Naturally, in patch type antennas, coupling can be provided either by contacting feeds (e.g. the aforesaid coaxial cable or a microstrip line) or by non-contacting feeds (e.g. an aperture or a proximity coupling).

Although the patch antenna 100 has been chosen as an example, it must be noticed that the antenna tuning method according to the embodiment of the invention is not limited to this particular antenna type.

In order to execute the antenna tuning method according to the embodiment of the invention, the antenna substrate 130 is constituted in a known manner so that said antenna substrate 130 comprises a dielectric fluid including added magnetic particles having a freedom to move if an ultrasonic field provided by an external ultrasonic transducer is applied, or the portion of the antenna substrate comprises the dielectric fluid including the magnetic particles having a freedom to move if an ultrasonic field provided by an external ultrasonic transducer is applied (not shown in the figure).

Figure 2A:
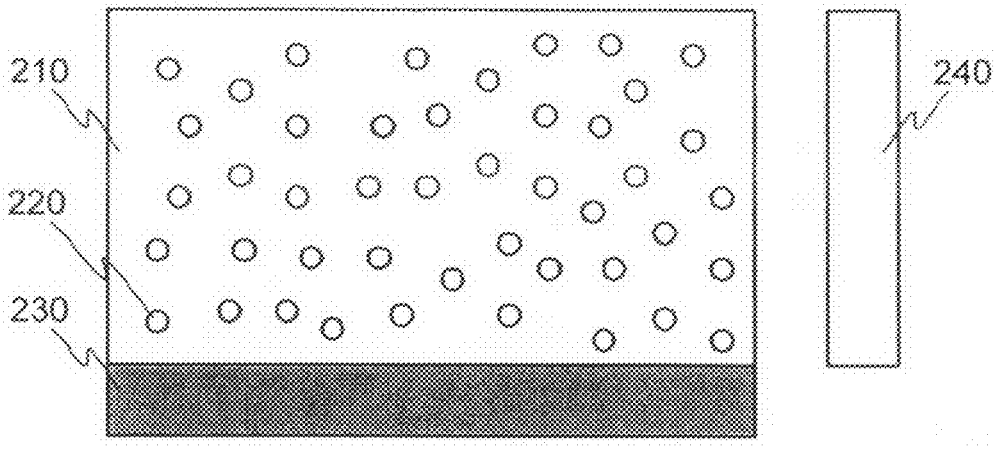
FIGS. 2*a*-2*c* illustrate an exemplary view of the control of the magnetic particles according to an advantageous embodiment of the invention.
Figure 2B:
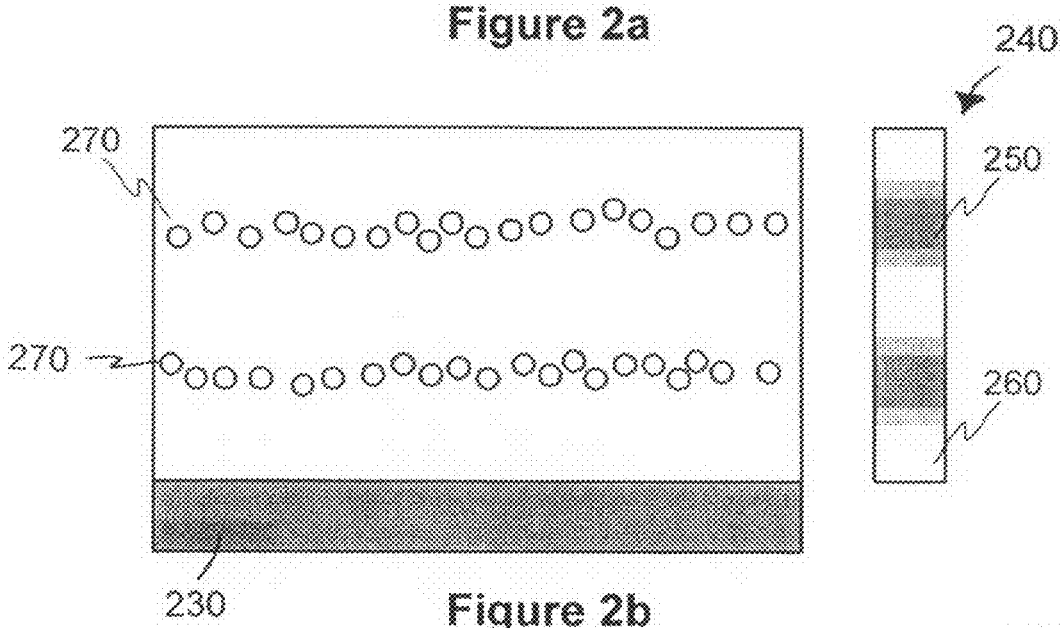
Figure 2C:
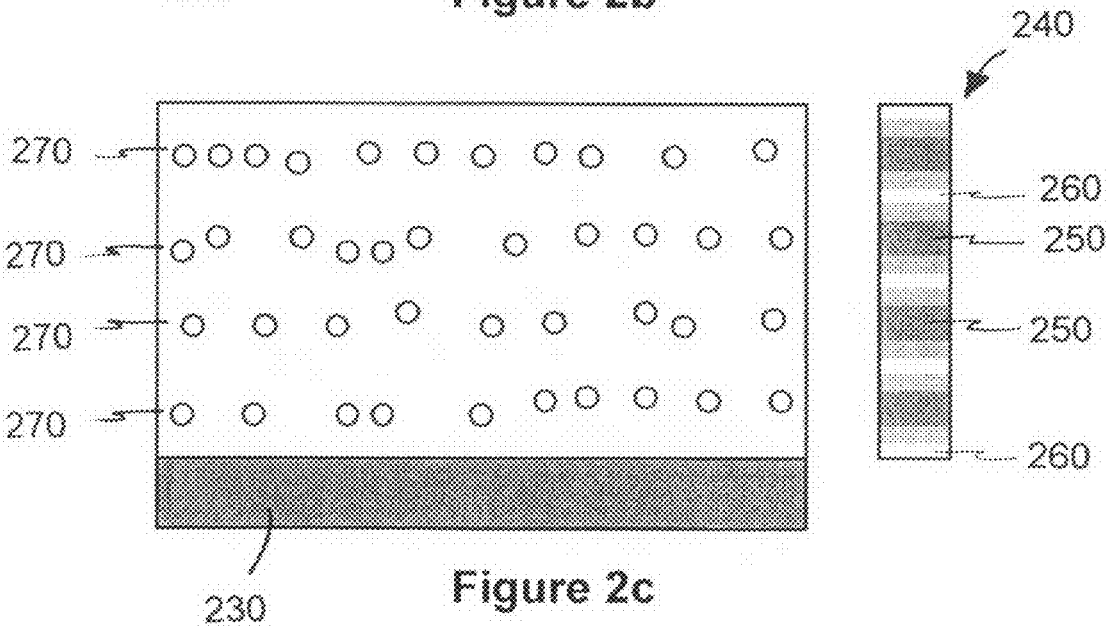

In FIGS. 2*a*-2*c* are represented in principle how the fluid of the antenna substrate, which comprises added magnetic particles, can be modified for changing the resonant frequency of the antenna.

FIG. 2*a* illustrates an undisturbed fluid 210 comprising added magnetic particles 220 having sub-micron physical dimensions, in other words said particles 220 have a largest dimension that is less than one micron. So, these magnetic particles can be called as nanoparticles. These nanoparticles 220 have a refractive index different to the refractive index of the fluid 210 and the particles 220 are extended throughout the fluid 210. The particles 220 can comprise metallic and/or ceramic particles. The metallic particles can comprise e.g. cobalt, iron, manganese, nickel, niobium, tungsten, vanadium, or rare earth metal particles. Furthermore, the particles can be composite particles having metallic cores surrounded by electrically insulating coatings or electrically insulating cores surrounded by metallic coatings [5].

An ultrasonic transducer 230 is installed in close contact with the fluid 210. Between the transducer 230 and the fluid 210 it is possible to use a suitable medium (not shown in the figure) in order to enable a fluent propagation for an ultrasonic signal.

The magnetic nanoparticles 220 in the fluid 210 are rearranged by means of an acoustic standing wave produced by the ultrasonic transducer 230 in a known manner.

The acoustic standing wave in a fluid has a varying energy density in its nodal planes, which locate normal to the axis of the propagation of the standing wave. The particles of the fluid, which are responsive to an acoustic energy, will concentrate in the nodal planes and this affects a particle distribution in the fluid [6].

Thus, the antenna tuning method according to the invention utilises the above-mentioned standing wave by applying an ultrasonic field to the fluid 210 and establishing the standing wave for piling up (concentrating) the magnetic nanoparticles 220 at nodal planes.

Next, in FIG. 2*b*, is illustrated a situation, wherein the ultrasonic transducer 230 produces the ultrasonic field into the fluid 210 (turning on the ultrasonic field). A box 240 on the right side of the figure depicts the pressure fluctuations of the ultrasonic field so that dark sections 250 represent the areas of the high pressure in the fluid 210 and white sections 260, for one, represent the areas of the low pressure in the fluid 210.

Once the ultrasonic field is applied into the fluid 210, the magnetic nanoparticles 220 concentrate to the areas of the high pressure 250 as layers 270, if the fluid 210 supports a standing wave at the ultrasonic frequency and the refractive index of the nanoparticles 220 is different from that of the antenna substrate material 210.

Generally speaking, switching the ultrasonic field on will lead to the periodic structure of the magnetic properties of the medium and this, in turn, will lead to the different tuning frequency of the antenna, particularly if the RF magnetic field distribution in the active space is non-uniform, which is normally the case.

FIG. 2*c* illustrates how the controlling of the frequency of the ultrasonic excitation allows controlling number of nanoparticle nodal planes 270. As one can see from the figure, the number of nanoparticle nodal planes 270 is increased by increasing the frequency of the ultrasonic excitation.

When the ultrasonic excitation is turned off, the nanoparticles 220 distribute again uniformly in the fluid 210.

The re-arranging of the magnetic nanoparticles 220 in a fluid 210 changes the properties of the fluid 210. For example, the relative magnetic permeability can alter by a factor of two or more. When the modified fluid 210 is placed on or near an antenna element, and a property that has been modified is either a magnetic permeability or a dielectric constant, the resonant frequency of the antenna will change.

Figure 3:
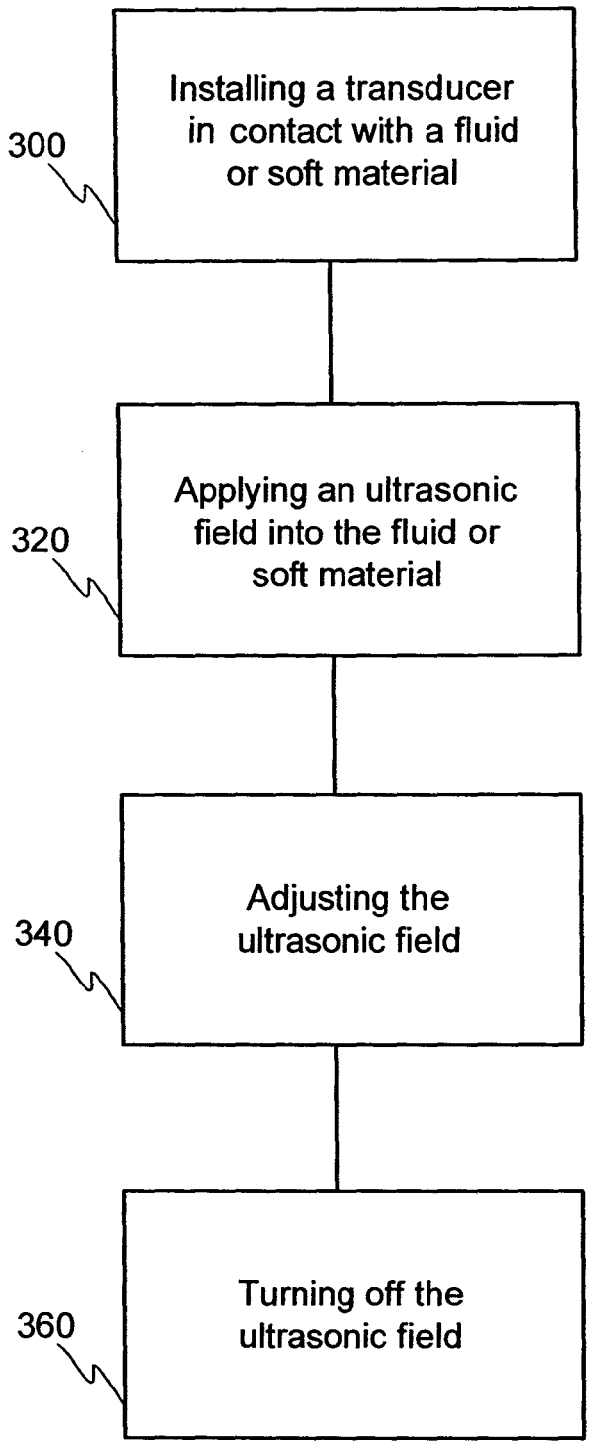
FIG. 3 illustrates an exemplary flowchart of the method for modifying an antenna substrate according to an advantageous embodiment of the invention.

FIG. 3 represents a flowchart according to the method in discussion. In first step 300, an ultrasonic transducer is installed in touch with a fluid, which comprises magnetic particles, so that it can provide an ultrasonic field into said fluid.

Then, according to step 320, the transducer is turned on for producing the ultrasonic field into said fluid. The magnetic particles arrange to layers as shown in FIG. 2*b* since a standing wave establishes in the fluid.

In step 340 the frequency of the ultrasonic can be adjusted in order to control the number of the layers of the magnetic particles. If the frequency is increased, the number of the particle layers (nodal planes) increases.

Since the ultrasonic field is turned off in step 360, the magnetic particles spread out again uniformly in the fluid. As a result from the above-presented particle manipulation, the properties of the fluid, preferably a magnetic permeability or a dielectric constant, have changed, and if the modified fluid is placed on or near an antenna element, it will present a change in the resonant frequency of the antenna.

An antenna having an antenna substrate, which is modified by the tuning method according to the invention, can be applied to various kind of devices such as mobile phones, laptops, GPS devices, and so on.

The invention has been now explained above with reference to the aforesaid embodiments and the several advantages of the invention have been demonstrated. It is clear that the invention is not only restricted to these embodiments, but comprises all possible embodiments within the spirit and scope of the invention thought and the following patent claims.

REFERENCES

[1] J. Ollikainen, *Design and implementation techniques of wideband mobile communications antennas*, Ph.D. Dissertation, TKK Helsinki University of Technology, 2004

[2] http://www.semiconductor.net/article/CA6436113.html

[3] 0. Kivekäs, J. Ollikainen, and P. Vainikainen, "*Frequency-tunable internal antenna for mobile phones", Proc.* 13*th IEEE International Symposium on Personal, indoor and Mobile Radio Communications* (*PIMRC* 2002), Lisbon, Portugal, 15-18 Sep. 2002, pp. 1882-1887, (CD-ROM, ISBN 0-7803-7590-4, paper: crl1593.pdf)

[4] Patent publication U.S. Pat. No. 6,437,747 B1

[5] Patent publication U.S. Pat. No. 6,842,140 B2

[6] Patent publication U.S. Pat. No. 4,877,516 A

What is claimed is:

1. A method comprising:

modifying a property of an antenna substrate by using an ultrasonic field, wherein at least a portion of said antenna substrate comprises magnetic particles of which at least some of said magnetic particles each have a lamest dimension that is less than one micron.

2. The method according to claim 1, wherein at least some of said magnetic particles each have a refractive index differing from a refractive index of said at least a portion of said antenna substrate.

3. The method according to claim 2, wherein said magnetic particles are surrounded by a dielectric fluid, which constitutes said at least a portion of said antenna substrate.

4. The method according to claim 3, wherein said method further comprises:

arranging said magnetic particles in said at least a portion of said antenna substrate by said ultrasonic field for modifying said property of said at least a portion of said antenna substrate.

5. The method according to claim 4, wherein said arranging magnetic particles in said at least a portion of said antenna substrate comprising applying said ultrasonic field into said at least a portion of said antenna substrate for concentrating said magnetic particles in areas of a high pressure and removing said ultrasonic field for distributing said magnetic particles evenly in said at least a portion of said antenna substrate.

6. The method according to claim 5, wherein said arranging magnetic particles in said at least a portion of said antenna substrate further comprises:

establishing a standing wave into said fluid constituting said at least a portion of said antenna substrate for achieving at least one nodal plane in which said magnetic particles concentrate.

7. The method according to claims 6, wherein said arranging said magnetic particles in said at least a portion of said antenna substrate further comprises:

adjusting a frequency of said ultrasonic field for controlling a number of said nodal planes of said standing wave in said at least a portion of said antenna substrate.

8. The method according to claim 1, wherein said property of said antenna substrate is a magnetic permeability or dielectric constant.

9. An antenna comprising:

an antenna substrate having a property, which is modifiable by an ultrasonic field, wherein at least a portion of said antenna substrate comprises magnetic particles of which at least some of said magnetic particles each have a largest dimension that is less than one micron.

10. The antenna according to claim 9, wherein at least some of said magnetic particles each have a refractive index differing from a refractive index of said at least a portion of said antenna substrate.

11. The antenna according to claim 10, wherein said magnetic particles are surrounded by a dielectric fluid, which constitutes said at least a portion of said antenna substrate.

12. The antenna according to claim 11, wherein at least a portion of said antenna substrate is capable of establishing a standing wave at an ultrasonic frequency.

13. The antenna according to claim 12, wherein said magnetic particles in said at least a portion of said antenna substrate are arranged by said ultrasonic field for modifying said property of said at least a portion of said antenna substrate.

14. The antenna according to claim 9, wherein said modified property of said antenna substrate is a magnetic permeability or dielectric constant.

15. The antenna according claim 9, wherein said antenna is a patch antenna comprising said modified antenna substrate between a patch and a ground plane.

16. An apparatus comprising:

an antenna substrate having a property, which is modifiable by an ultrasonic field, wherein at least a portion of said antenna substrate comprises magnetic particles of which at least some of said magnetic particles each have a largest dimension that is less than one micron.

17. The apparatus according to claim 16, wherein at least some of said magnetic particles each have a refractive index differing from a refractive index of said at least a portion of said antenna substrate.

18. The apparatus according to claim 17, wherein said magnetic particles are surrounded by a dielectric fluid, which constitutes said at least a portion of said antenna substrate.

19. The apparatus according to claim 18, wherein said at least a portion of said antenna substrate is capable of establishing a standing wave at an ultrasonic frequency.

20. The apparatus according to claim 19, wherein said magnetic particles in said at least a portion of said antenna substrate are arranged by said ultrasonic field for modifying said property of said at least a portion of said antenna substrate.

21. The apparatus according to claim 16, wherein said modified property of said antenna substrate is a magnetic permeability or dielectric constant.

22. The apparatus according to claim 16, wherein said apparatus comprises a patch antenna comprising said modified antenna substrate between a patch and a ground plane.

23. The apparatus according to claim 16, wherein said apparatus is a mobile communications device.

24. An apparatus comprising:

an antenna substrate, means for modifying a property of said antenna substrate, wherein at least a portion of said antenna substrate comprises magnetic particles of which at least some of said magnetic particles each have a largest dimension that is less than one micron.

* * * * *